US008518188B2

(12) United States Patent
Kim et al.

(10) Patent No.: US 8,518,188 B2
(45) Date of Patent: Aug. 27, 2013

(54) METHOD OF CONTROLLING DISHWASHER

(75) Inventors: Seong Ho Kim, Yongin-si (KR); Sang Heon Yoon, Gwangmyung-si (KR); Tao Hee Lee, Boocheon-si (KR)

(73) Assignee: LG Electronics Inc., Seoul (KR)

( * ) Notice: Subject to any disclaimer, the term of this patent is extended or adjusted under 35 U.S.C. 154(b) by 720 days.

(21) Appl. No.: 11/883,795

(22) PCT Filed: Mar. 23, 2007

(86) PCT No.: PCT/KR2007/001445
§ 371 (c)(1),
(2), (4) Date: Apr. 19, 2010

(87) PCT Pub. No.: WO2008/047981
PCT Pub. Date: Apr. 24, 2008

(65) Prior Publication Data

US 2010/0206332 A1 Aug. 19, 2010

(30) Foreign Application Priority Data

Oct. 17, 2006 (KR) ..... 10-2006-0100608

(51) Int. Cl.
*B08B 9/20* (2006.01)

(52) U.S. Cl.
USPC ..... 134/25.2; 134/18; 134/19; 134/30

(58) Field of Classification Search
None
See application file for complete search history.

(56) References Cited

U.S. PATENT DOCUMENTS

| | | | |
|---|---|---|---|
| 1,142,083 | A | 6/1915 | Dodge |
| 4,135,531 | A | 1/1979 | Federighi et al. |
| 4,235,642 | A | 11/1980 | Federighi et al. |
| 4,246,916 | A | 1/1981 | Fay et al. |
| 4,279,384 | A | 7/1981 | Yamamoto |
| 4,457,323 | A | 7/1984 | Fay et al. |
| 6,422,180 | B1 | 7/2002 | Yiu |
| 6,997,196 | B2 | 2/2006 | Eiermann |

FOREIGN PATENT DOCUMENTS

| | | |
|---|---|---|
| CN | 1682643 | 10/2005 |
| CN | 1931080 | 3/2007 |
| JP | 02-082930 | 3/1990 |
| KR | 10-1999-0012221 | 2/1999 |
| KR | 10-2002-0077643 | 10/2002 |
| KR | 10-2005-0068453 A | 7/2005 |
| KR | 10-2006-0077273 A | 7/2006 |

*Primary Examiner* — Eric Golightly
(74) *Attorney, Agent, or Firm* — McKenna Long & Aldridge LLP

(57) ABSTRACT

There is provided a method of controlling a dishwasher. The method includes performing a preliminary washing cycle, performing a main washing cycle, and performing a rinsing cycle. Steam is supplied during at least one of the main washing cycle and the rinsing cycle.

13 Claims, 4 Drawing Sheets

METHOD OF CONTROLLING DISHWASHER

This application claims the benefit of PCT/KR07/01445 filed on Mar. 23, 2007 which claims priority to Korean Patent Application No. KR 10-2006-0100608, filed on Oct. 17, 2006, which are hereby incorporated by reference for all purposes as if fully set forth herein.

BACKGROUND

1. Field of the Disclosure

The present disclosure relates to a method of controlling a home appliance and, more particularly, to a method of controlling a steam spray performed during a washing cycle for use in a home appliance, such as a dishwasher.

2. Description of the Related Art

A dishwasher is a home appliance that is known to wash dishes by spraying high pressure washing water onto surfaces of dishes within a washing chamber.

Various methods have been contemplated to improve the washing efficiency of a dishwasher, including introducing steam to improve the efficiency of removing any food residue adhered to dishes.

In a conventional dishwasher, steam is generated within a washing chamber in a variety ways. For example, steam could be generated in the washing chamber when water supplied to a sump in the washing chamber is heated to a temperature where water evaporates, thereby creating steam within the washing chamber. Alternatively, a separate steam generating device could be mounted outside the washing chamber whereby steam generated within the steam generating device is introduced into the washing chamber via a steam hose.

In the above-described conventional dishwashers, the steam washing function and a main washing process are performed separately. That is, the washing process is stopped while steam is introduced to the washing chamber. Steam is introduced into the washing chamber until a predetermined amount of time elapses and the temperature within the washing chamber reaches a predetermined level, then the steam washing process is finished. Any food residue adhered to the dishes in the washing chamber absorb moisture of the steam, allowing the residue to be more easily removed. Subsequently, high pressure washing water is sprayed through spray nozzles to remove the food residue from the dishes.

In the above described conventional washing method, the overall washing time is prolonged because the steam washing function and the main washing process must be performed separately. Moreover, the process of generating steam does not begin until the main washing process is stopped. That is, steam does not immediately begin to be introduced into the washing chamber upon initiation of the steam washing function, rather the water must first reach the appropriate temperature to produce the steam and then the steam is introduced into the washing chamber.

Furthermore, during the steam washing process of the conventional dishwasher, an initial, predetermined amount of water is supplied to generate steam at the outset of the steam washing process. If this initial amount of water is fully consumed before the predetermined time has elapsed and the predetermined temperature level has been reached, more water must be supplied and heated to the appropriate temperature to produce the steam. Thus, steam cannot be continuously supplied to the washing chamber.

SUMMARY

Accordingly, the disclosure is directed to a method of controlling a home appliance that substantially obviates one or more problems due to limitations and disadvantages in the art.

A method of controlling a home appliance for improving washing efficiency is highly desirable.

A method of controlling a home appliance that can reduce the overall washing time while effectively performing a steam washing is also highly desirable.

In addition, a method of controlling a home appliance wherein the water supply used in the generation of steam is continuously heated is highly desirable.

Additional features and advantages will be set forth in part in the description which follows, and in part will be apparent to those having ordinary skill in the art upon examination of the following. Alternatively, additional features and advantages may be learned from practice of the invention. The aforementioned features and advantages may be realized and attained by the exemplary structure or exemplary method pointed out in the written description, claims and the appended drawings.

One advantage may be achieved by a method of controlling a dishwasher having a washing chamber, includes intermittently supplying washing water to the washing chamber during an operational cycle of the dishwasher; and supplying steam to the washing chamber during the operational cycle while washing water is being supplied.

Another advantage may be achieved by a method of controlling a dishwasher having a washing chamber, including: a plurality of water supply periods during an operational cycle, wherein each of said water supply periods includes intermittent washing water supplying events, wherein the washing water is supplied to the washing chamber; and a soak period between two consecutive water supply periods, wherein steam is supplied to the washing chamber during a water supplying event for each water supply period.

Another advantage may be achieved by a method of controlling a dishwasher having a washing chamber, including supplying washing water to the washing chamber during an operational cycle of the dishwasher, wherein the washing water is supplied to the washing chamber through a water nozzle; and supplying steam to the washing chamber while washing water is being supplied, wherein the steam is supplied to the washing chamber through a steam nozzle, separate from the water nozzle.

Another advantage may be achieved by a home appliance including a washing chamber; means for intermittently supplying washing water to the washing chamber during an operational cycle of the home appliance; and means for supplying steam to the washing chamber during the operational cycle while washing water is being supplied.

It is to be understood that both the foregoing general description and the following detailed description are exemplary and explanatory and shall not be construed as limiting the scope of the claims.

BRIEF DESCRIPTION OF THE DRAWINGS

The accompanying drawings, which are included to provide a further understanding, are incorporated in and constitute a part of this application. The drawings illustrate various embodiments and together with the description serve to explain some principles of the invention. In the drawings.

DETAILED DESCRIPTION

Reference will now be made in detail to embodiments of the present invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art.

Figure 1:
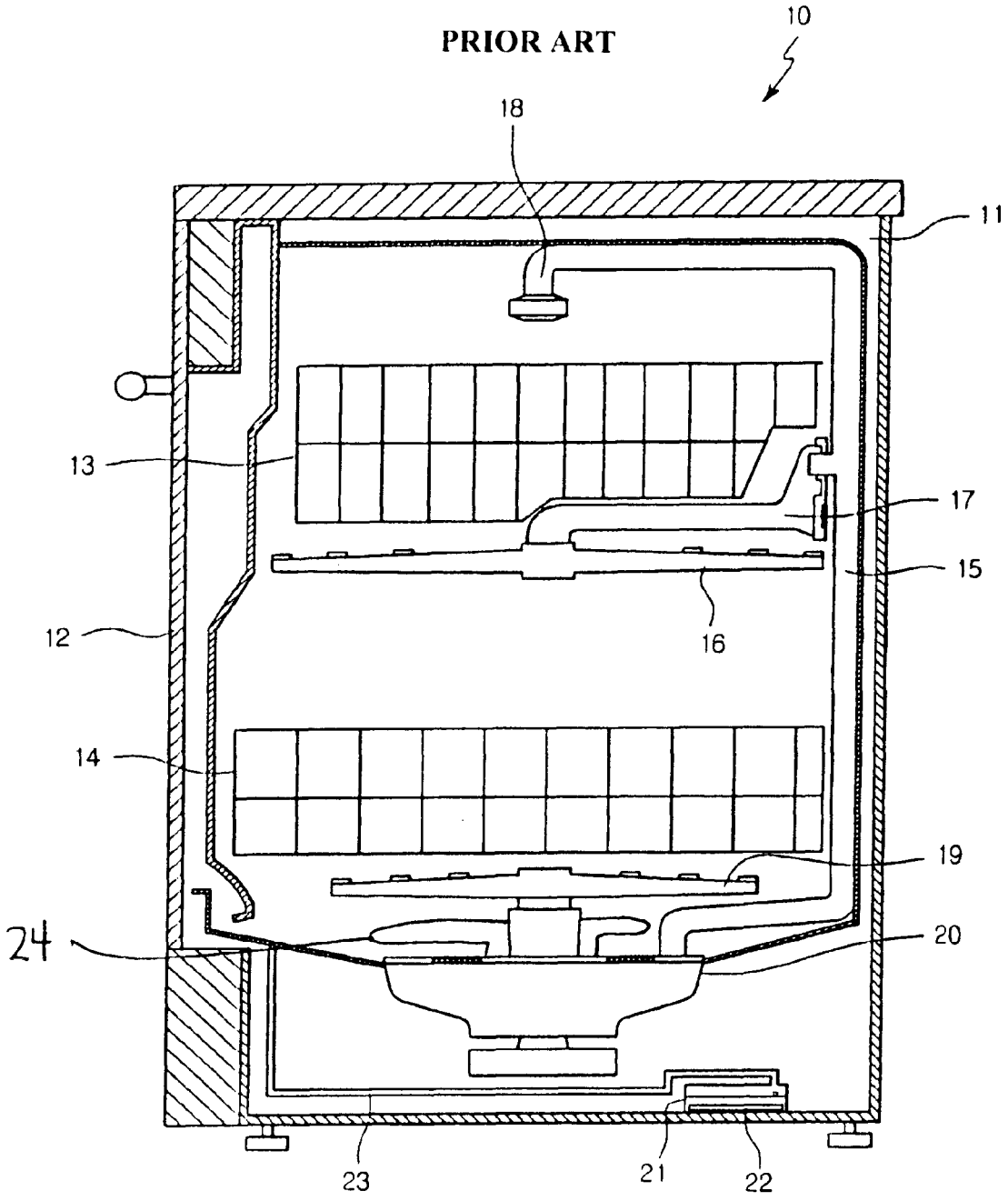
FIG. 1 PRIOR ART
FIG. 1 is a schematic perspective view of a dishwasher to which a control method of an embodiment of the present invention can be applied.

FIG. 1 is a schematic perspective view of a dishwasher to which a control method of an embodiment of the present invention can be applied.

Referring to FIG. 1, a dishwasher 10 may include a door 12 pivotally installed on a front portion of the tub 11, a tub 11 defining a washing chamber, a sump 20 that pumps water into the tub, a heater 24 installed within the sump, a water guide 15 that may guide the water pumped by the sump 20, a spray nozzle for spraying the washing water into the washing chamber, and racks on which objects, for example dishes, may be loaded, and a steam generating device 21 that may supply steam to the tub 11.

The racks may include an upper rack 13 provided in an upper portion of the tub 11 and a lower rack 14 provided in a lower portion of the tub 11. The upper and lower racks 13 and 14 may be installed to be removable from the tub 11.

The water guide 15 may be vertically provided on an inner surface of the tub 11. Opposite ends of the water guide 15 may be bent such that the water guide 15 may have a shape similar to a "C" shape. The water guide 15 may be connected to the sump 20 to guide water pumped out of the sump 20 to the spray nozzles.

In addition, the spray nozzles may include a lower nozzle 19 that may be mounted on a central portion of the sump 20 to spray the washing water in various directions including, for example, in the direction of the lower rack 14. An upper nozzle 16 may be provided within the washing chamber to spray the washing water in various directions including, for example, in the direction of the lower rack 14 and/or the upper racks 13. A top nozzle 18 may be coupled to an upper end of the water guide 15 to spray the washing water in various directions including, for example, in a downward direction. The upper nozzle 16 may be connected to the water guide 15 by a nozzle holder 17 that extends from the upper nozzle 16. The nozzle holder may be mounted on a portion of the water guide 15, for example a front portion of the water guide. Whereby the upper nozzle 16 may receive the washing water from the water guide 15 via the nozzle holder 17.

Water supplied to the steam generating device 21 may be heated by the heater 22, thereby evaporating the water into the steam. The water supplied to the steam generating device may be separate from the water supplied to the washing chamber. Further, the steam may be introduced into the tub 11 by various means. For example, a steam supply passage 23 may be connected between the steam generating device 21 and the tub to supply the steam generated in the steam generating device 21 to the tub 11 through a steam nozzle.

The dishwasher may also include a locking mechanism to lock the door of the dishwasher. The internal temperature of the washing chamber may be monitored using a temperature sensor. When a user attempts to open the door of the dishwasher during any portion of a washing mode, if the sensed temperature is determined to be above a predetermined temperature, the locking mechanism may remain engaged until the sensed temperature is determined to be below the predetermined temperature. The locking mechanism may also remain engaged if a sensed water level is above a predetermined water level. If a user attempts to open the door of the dishwasher when the water level is determined to be above a predetermined level, the locking mechanism may remain engaged until water is drained from the washing chamber and the water level is determined to be below the predetermined level.

An operation of dishwasher 10 will now be described.

The door 12 of the dishwasher may be opened and upper rack 13 and/or lower rack 14 may be withdrawn from the tub 11. Objects may be arranged on the racks 13 and 14, the racks may be returned to the tub 11 and the door 12 closed. Detergent or rinse may be supplied to a dispensing container before the door 12 is closed.

The dishwasher may perform a plurality of washing modes, where a controller stores control information associated with each of the plurality of washing modes. A desired washing mode may be selected and/or entered through a selector provided on a control panel of the dishwasher. In response to the selected washing mode, the controller sends a control signal to the corresponding elements of the dishwasher to perform the selected washing mode.

An exemplary operation of the dishwasher 10 will now be described. After selection of a washing mode, the controller sends control signals to execute the washing mode and washing water is supplied into the sump 20 up to a predetermined water level. A sump pump (not shown) pumps the washing water out of the sump 20. The washing water pumped out by the sump pump may be alternately directed to the water guide 15 and the lower nozzle 19.

A portion of the washing water flowing along the water guide 15 may be directed to the upper nozzle 16 along the nozzle holder 17 and the rest of the washing water may be directed to the top nozzle 18. The washing water may be sprayed into the tub 11 through lower nozzle 19 for a predetermined time and subsequently the washing water may be sprayed through the upper nozzle 16 and/or top nozzle for a predetermined time. This alternative spaying may be repeatedly performed during the washing of the dishes.

The washing water directed to the upper, top, and lower nozzles 16, 18, and 19 may be sprayed into the washing chamber of the tub 11 through spraying holes formed on the nozzles. The spraying holes in the nozzles may increase the pressure of the washing water such that the food residue adhered to the dishes loaded on the upper and/or lower racks 13 and/or 14 may be removed from the dishes.

Figure 2:
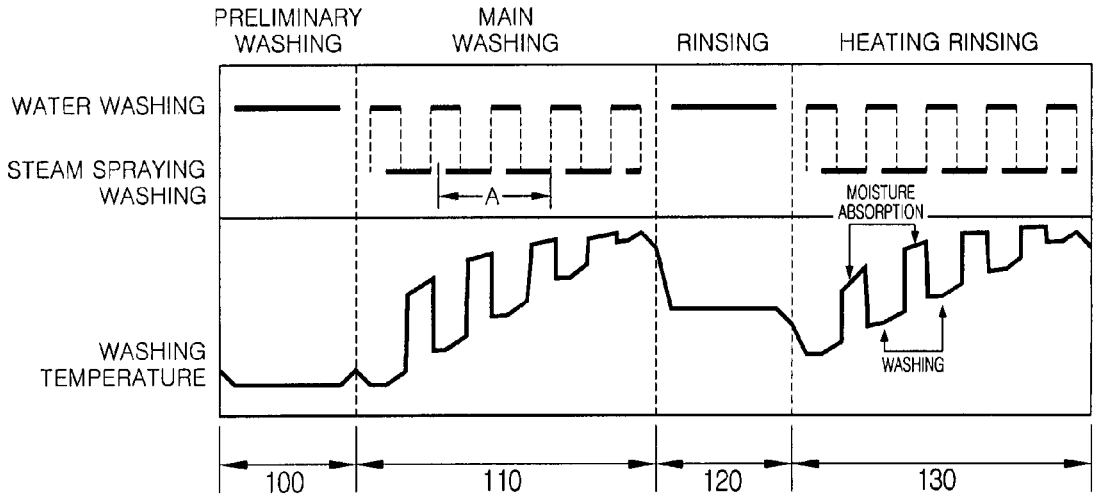
FIG. 2 is a graph illustrating a cycle realized by a method of controlling a dishwasher according to an embodiment of the present invention.

FIG. 2 is a graph illustrating a cycle realized by a method of controlling a dishwasher according to an embodiment of the present invention.

Referring to FIG. 2, after a washing mode is selected, a preliminary washing cycle 100 may be performed. During a preliminary washing cycle 100, washing water that is not mixed with detergent may be sprayed into the washing chamber of the tub 11 through nozzles 16, 18 and 19. In addition, the washing water may not be heated, thus the temperature within the washing chamber may be substantially constant. At the conclusion of the preliminary wash cycle 100, any residue removed from the dishes during the preliminary wash cycle 100 may be filtered and/or removed from the washing chamber prior to the start of the next cycle.

After the preliminary washing cycle 100 is finished, a main washing cycle 110 may be performed. The main washing cycle may be repeatedly performed during one selected washing mode. Further, the main washing cycle 110 may be divided into a water supply phase and a steam supply phase.

During the water supply phase of the main washing cycle, the washing water may contain detergent and may be sprayed into the washing chamber of the tub 11 through nozzles 16, 18 and 19. The water supply phase of the main washing cycle may also include intermittently spraying washing water into the washing chamber. If the washing water is intermittently sprayed, the portion of the water washing phase in which washing water is not supplied to the washing chamber may be considered a soaking portion of the water washing phase. The soaking portion may allow any food residue remaining on the dishes to absorb moisture to improve removal of the residue. In addition, the water spraying portion and the soaking portion of the water washing phase may be repeated several times during the main washing cycle.

In the steam supply phase of the main washing cycle 110, water is supplied to the steam generator, heated and then supplied to the washing chamber through a nozzle. Steam may be supplied to the washing chamber at various intervals during the main washing cycle. For example, steam may be continuously supplied to the washing chamber during the main washing cycle or steam may be supplied after the water washing phase begins or steam may be introduced in intervals throughout the main washing cycle.

As shown in FIG. 2, steam may be supplied to the washing chamber after the water washing phase has been begun and steam may also be continuously supplied during the soaking portion of the water washing phase. The steam may be stopped for a short time after the soaking portion is finished and the water washing phase resumes. During the time in which the steam is not supplied to the washing chamber, water may be resupplied to the steam generator 21 for continuous steam generation. This allows the steam to be continuously supplied during the soaking portion of the water washing period thus the washing efficiency may be further improved.

Figure 3:
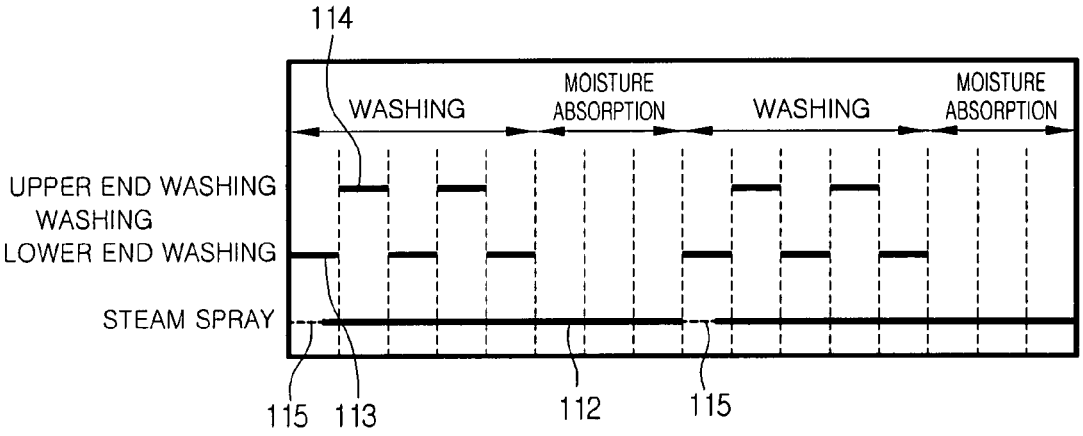
FIG. 3 is a graph illustrating a cycle of a portion A of FIG. 2.
Figure 4:
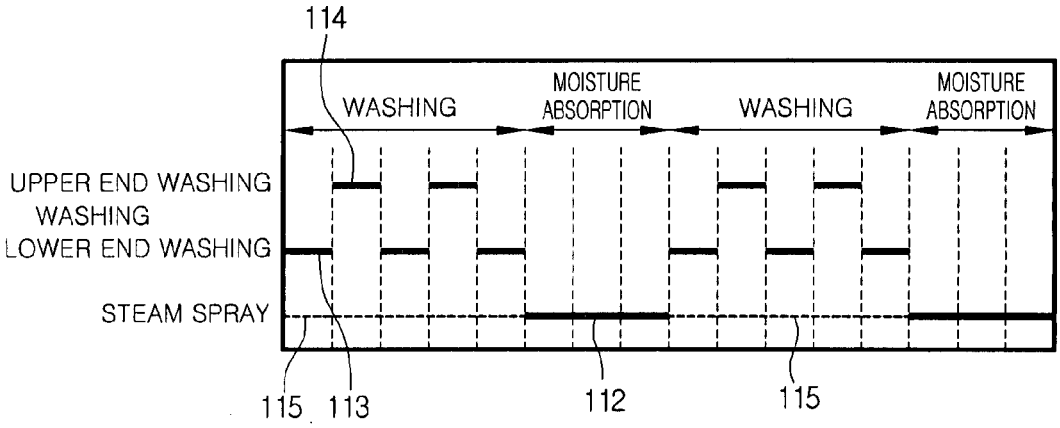
FIG. 4 is a graph illustrating a steam supplying process according to another embodiment of the present invention.

As shown in FIG. 3, the water supply portion of the water washing period may be further divided into an upper washing portion 114 and a lower washing portion 113 where the upper washing portion and the lower washing portion may be alternately performed. During the upper washing portion 114, washing water may be supplied to the washing chamber via the upper nozzle 16 and/or top nozzle 18. During the lower washing portion 113, washing water may be supplied to the washing chamber via the lower nozzle 19. When the water supply portion comprises an upper washing and a lower washing, steam may be supplied after the lower washing begins and may continue until the end of the soak portion. During the portion of the cycle in which steam is not supplied to the washing chamber, water may be resupplied to the steam generator. In an alternative embodiment, as shown in FIG. 4, steam may be supplied only during the soaking portion of the water supply period of the main washing cycle.

During the course of the main washing cycle, the temperature within the washing chamber continually increases until a maximum temperature is reached. As shown in FIG. 2, when steam is supplied to the washing chamber, the temperature within the tub temporarily increases within the washing chamber. When steam is not supplied to the washing chamber, a sump heater may be energized to heat the washing water in the sump to aid in raising the temperature of the washing water and the temperature within the washing chamber. The sump heater may be deenergized when steam is supplied to the washing chamber.

At the conclusion of the main washing cycle 110, any residue removed from the dishes during the main washing cycle 110 may be filtered and/or removed from the washing chamber prior to the start of the next cycle. The washing water used during the main washing cycle 110, which may contain detergent, may be drained from the sump prior to the start of the next cycle.

When the main washing cycle 110 is complete, a rinsing cycle may be performed. The rinsing cycle may be repeatedly performed during the selected washing mode. Further, the rinsing cycle may include a rinsing phase 120 and a heated rinse phase 130. During the rinsing phase 120, washing water may be sprayed into the washing chamber from the nozzles 16, 18 and 19 thereby rinsing any residue from the dishes. The washing water may or may not include detergent or rinse. The rinsing phase 120 may be performed using normal temperature washing water, thus the temperature within the washing chamber may be substantially consistent.

A heated rinse phase 130 may be performed following the rinsing phase 120. The heated rinse phase 130 may also include a rinsing portion for spraying the water into the washing chamber and a steam spraying portion for spraying the steam into the washing chamber. During the rinsing portion of the heated rinse phase, washing water, which may or may not include a rinse or detergent, may be sprayed into the washing chamber of the tub 11 through nozzles 16, 18 and 19. The rinsing phase may also include a soaking portion in which may occur between two intermittent washing water events. The soaking portion may allow any food residue remaining on the dishes to absorb moisture to improve removal of the residue. In addition, the rinsing portion and the soaking portion may be repeated several times during the heated rinse phase. The rinsing portion of the heated rinse phase may be further divided into an upper rinse portion and a lower rinse portion. During the upper rinse portion, washing water may be supplied to the washing chamber via the upper nozzle 16 and/or top nozzle 18. During the lower rinse portion, washing water may be supplied to the washing chamber via the lower nozzle 19. The upper rinse portion and the lower rinse portion may be alternately performed during the heated rinse phase.

In the steam supply portion of the heated rinse phase, water may be supplied to the steam generator, heated and then supplied to the washing chamber through a steam nozzle via a steam pipe. The outlet of the steam nozzle may be of a relatively small diameter, such that the nozzle may act like a barrier to the steam which may lead to an increase in pressure between the steam pipe and the steam nozzle. This pressure may increase slightly over atmospheric pressure. With an increase in pressure, the steam may be introduced into the washing chamber with significant pressure.

Steam may be supplied to the washing chamber at various intervals during the heated rinse phase. For example, steam may be continuously supplied to the washing chamber during the heated rinse phase or steam may be supplied after the rinse phase begins or steam may be introduced in short bursts throughout the heated rinse phase.

As shown in FIG. 2, steam may be supplied to the washing chamber after the rinse portion of the heated rinse phase has been begun and steam may also be continuously supplied during the soaking portion of the heated rinse phase. The steam may be stopped for a short time after the soaking portion is finished and the rinse portion resumes. During the time in which the steam is stopped, water may be resupplied to the steam generator 21. In this case, since the steam may be continuously supplied during the soaking portion, the washing efficiency may be further improved.

During the course of the heated rinse phase, the temperature within the washing chamber continually increases until a maximum temperature is reached. As shown in FIG. 2, when steam is supplied to the washing chamber, the temperature temporarily increases within the washing chamber. When steam is not supplied to the washing chamber, a sump heater may be energized to heat the washing water in the sump to aid in raising the temperature of the washing water and the temperature within the washing chamber. The sump heater may be deenergized when steam is supplied to the washing chamber. At the conclusion of the rinsing cycle, any residue removed from the dishes during the rinsing cycle may be filtered and removed from the washing chamber prior to the start of the next cycle.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A method of controlling a dishwasher, wherein the dishwasher includes a washing chamber, the method comprising:

supplying washing water to a sump;

supplying washing water to a steam generating device, the steam generating device provided independently at an outside of the sump;

intermittently supplying washing water to the washing chamber during an operational cycle of the dishwasher by controlling a sump pump to deliver water in the sump to the washing chamber through a plurality of water nozzles, the sump located below and communicating with the washing chamber such that the water supplied to the washing chamber returns to the sump;

heating the steam generating device to generate steam; and supplying the steam generated in the steam generating device to the washing chamber during the operational cycle while washing water is being supplied, the steam supplied to the washing chamber through a steam nozzle which is independently provided from the water nozzles and connected to the steam generating device;

wherein the washing water is alternately supplied through a water nozzle located in an upper portion of the washing chamber and a water nozzle located in a lower portion of the washing chamber among the plurality of water nozzles, and wherein the steam is supplied to the washing chamber between two consecutive washing water supply events.

2. The method of claim 1, wherein the washing water and the steam are simultaneously supplied to the washing chamber during a portion of either washing water event.

3. The method of claim 1, wherein the steam is supplied to the washing chamber between two consecutive washing water supply events.

4. The method of claim 1, wherein when the washing water is supplied in the upper portion of the washing chamber, the washing water is supplied through an upper nozzle or a top nozzle.

5. The method of claim 1, wherein when the washing water is supplied in the upper portion of the washing chamber, the washing water is supplied through an upper nozzle and a top nozzle.

6. The method of claim 1, wherein said operational cycle is a main washing cycle.

7. The method of claim 1, wherein said operational cycle is a rinsing cycle.

8. The method of claim 1, wherein said operational cycle is a main washing cycle and a rinsing cycle.

9. The method of claim 8, wherein the rinsing cycle comprises:

a rinse portion and a heated rinse portion, wherein the steam is supplied to the washing chamber during the heated rinse portion of the rinsing cycle.

10. The method of claim 9, further comprising:

a pre-washing cycle prior to the main washing cycle.

11. The method of claim 1, wherein supplying washing water and supplying the steam are repeatedly performed.

12. The method of claim 11, wherein a temperature within the washing chamber increases as supplying washing water and supplying steam are repeatedly performed.

13. The method of claim 12, wherein a sump heater is energized during at least supplying washing water to the washing chamber.

* * * * *